US009569989B2

(12) United States Patent
Huang et al.

(10) Patent No.: US 9,569,989 B2
(45) Date of Patent: Feb. 14, 2017

(54) PANEL DRIVER IC AND COOLING METHOD THEREOF

(71) Applicant: Novatek Microelectronics Corp., Hsinchu (TW)

(72) Inventors: Ju-Lin Huang, Hsinchu County (TW); Jhih-Siou Cheng, New Taipei (TW); Chun-Yung Cho, Hsinchu County (TW); Chieh-An Lin, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 681 days.

(21) Appl. No.: 13/928,376

(22) Filed: Jun. 26, 2013

(65) Prior Publication Data

US 2014/0139270 A1 May 22, 2014

(30) Foreign Application Priority Data

Nov. 20, 2012 (TW) ..... 101143311 A

(51) Int. Cl.
*G09G 3/00* (2006.01)

(52) U.S. Cl.
CPC ..... *G09G 3/00* (2013.01); *G09G 2300/0838* (2013.01); *G09G 2300/0871* (2013.01);
(Continued)

(58) Field of Classification Search
CPC .... G09G 3/20; G09G 3/36; G09G 2300/0838; G09G 2300/0871; G09G 2310/0289
See application file for complete search history.

(56) References Cited

U.S. PATENT DOCUMENTS 8,115,786 B2 2/2012 Chang
8,736,532 B2 5/2014 Oh
(Continued)

FOREIGN PATENT DOCUMENTS

CN 101551982 10/2009
CN 101663696 3/2010
(Continued)

OTHER PUBLICATIONS

"Office Action of China Counterpart Application", issued on Oct. 8, 2015, p. 1-p. 5.
(Continued)

*Primary Examiner* — Kenneth Bukowski
(74) *Attorney, Agent, or Firm* — Jianq Chyun IP Office

(57) ABSTRACT

A panel driver integrated circuit (IC) and a cooling method of the panel driver IC are provided. The panel driver IC includes a data encoder, a level shifter, a Digital-to-Analog Converter (DAC), a rearrangement circuit and an output buffer. The data encoder receives and selectively changes an original data for outputting to the level shifter. An input terminal and an output terminal of the level shifter are coupled to an output terminal of the data encoder and a data input terminal of the DAC, respectively. The output terminals of the rearrangement circuit are respectively coupled to the reference voltage input terminals of the DAC for providing different reference voltages. The rearrangement circuit correspondingly rearranges the order of the reference voltages according to the operation of the data encoder. An input terminal of the output buffer is coupled to an output terminal of the DAC.

7 Claims, 9 Drawing Sheets

(52) U.S. Cl.
CPC ..... *G09G 2310/0213* (2013.01); *G09G 2310/0289* (2013.01); *G09G 2330/045* (2013.01)

(56) References Cited

U.S. PATENT DOCUMENTS

| | | | | |
|---|---|---|---|---|
| 2004/0164943 | A1* | 8/2004 | Ogawa | G09G 3/3655 345/92 |
| 2006/0087483 | A1 | 4/2006 | Takada et al. | |
| 2009/0251495 | A1 | 10/2009 | Chang | |
| 2010/0141687 | A1 | 6/2010 | Han et al. | |
| 2012/0081038 | A1* | 4/2012 | Li | G09G 3/3677 315/307 |
| 2012/0162178 | A1 | 6/2012 | Oh | |

FOREIGN PATENT DOCUMENTS

| | | |
|---|---|---|
| CN | 102568421 | 7/2012 |
| KR | 20070121076 | 12/2007 |
| TW | 200739484 | 10/2007 |
| TW | I342547 | 5/2011 |
| TW | 201145247 | 12/2011 |

OTHER PUBLICATIONS

"Office Action of Taiwan Counterpart Application" , issued on Jan. 15, 2015, p. 1-p. 3.

* cited by examiner

PANEL DRIVER IC AND COOLING METHOD THEREOF

CROSS-REFERENCE TO RELATED APPLICATION

This application claims the priority benefit of Taiwan application serial no. 101143311, filed on Nov. 20, 2012. The entirety of the above-mentioned patent application is hereby incorporated by reference herein and made a part of this specification.

BACKGROUND OF THE INVENTION

Technical Field

The invention relates generally to an integrated circuit (IC), and more particularly to a panel driver IC and a cooling method thereof.

Description of Related Art

In a conventional panel driver integrated circuit, the level shifter and the output buffer are the main cause for the internal temperature to rise. As more output bits of the level shifter change states, the level shifter generate more heat, and accordingly the temperature of the converter increases. For example, the heat generated when the digital data outputted by the level shifter changes from 00000000 to 11111111 (i.e. 255) is bound to be far greater than the heat generated when 00000000 changes to 00000001.

As for the output buffer, when the output voltage swing is too wide, the output buffer generates excess heat and causes the buffer temperature to be too high. For example, the heat generated when the analog voltage of the output buffer changes from the lowest grayscale voltage (e.g. V(0)) to the highest grayscale voltage (e.g. V(255)) is bound to be far greater than the heat generated when the grayscale voltage V(0) changes to the grayscale voltage V(1).

Accordingly, when the pixel data transitions from 00000000 to 11111111, both the level shifter and the output buffer generate high temperate simultaneously and cause the chip temperature to rise drastically. The chip temperature increase alters the circuit characteristics and lowers the reliability.

SUMMARY OF THE INVENTION

The invention provides a panel driver integrated circuit (IC) and a cooling method of the panel driver IC, in which by changing the corresponding relationships between the digital data of the level shifter and the analog voltage of the output buffer, the temperature of the panel driver IC can be lowered.

Embodiments of the invention provide a panel driver IC, including a data encoder, a level shifter, a digital-to-analog converter (DAC), a rearrangement circuit and an output buffer. The data encoder receives an original data and selectively performs an encoding operation. The encoding operation changes the original data to serve as an output data of the data encoder according to a data mapping table. An input terminal of the level shifter is coupled to the data encoder to receive the output data. A data input terminal of the DAC coupled to an output terminal of the level shifter. A plurality of output terminals of the rearrangement circuit are coupled to a plurality of reference voltage input terminals of the DAC to provide a plurality of reference voltages. The rearrangement circuit rearranges an order of the reference voltages according to the encoding operation of the data encoder. An input terminal of the output buffer is coupled to an output terminal of the DAC.

Embodiments of the invention provide a cooling method of a panel driver IC, including: analyzing the relationships between different data transition patterns and different temperatures of a level shifter in the panel driver IC. The data transition patterns include a first transition pattern and a second transition pattern, the first transition pattern belongs to a high temperature region in the temperatures of the level shifter, and the second transition pattern belongs to a low temperature region in the temperatures of the level shifter. The cooling method further includes: analyzing the relationships between different voltage transition patterns and different temperatures of an output buffer in the panel driver IC. The voltage transition patterns include a third transition pattern and a fourth transition pattern, the third transition pattern belongs to a high temperature region in the temperatures of the output buffer, and the fourth transition pattern belongs to a low temperature region in the temperatures of the output buffer. The cooling method further includes: when the first transition pattern and the third transition pattern have a corresponding relationship, replacing the first transition pattern with the second transition pattern to establish the corresponding relationship with the third transition pattern, or replacing the third transition pattern with the fourth transition pattern to establish the corresponding relationship with the first transition pattern.

In summary, by reducing the current consumption of the level shifter (or output buffer), embodiments of the invention can lower the temperature of the panel driver IC. For example, when the level shifter is about to consume a large amount of current, the output power consumption of the output buffer is reduced. On the other hand, when the output buffer is about to consume a large amount of power, the current consumption of the level shifter is reduced. That is to say, by changing the corresponding relationships between the digital data of the level shifter and the analog voltage of the output buffer, the temperature of the panel driver IC can be lowered.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Unless limited otherwise, the terms "connected," "coupled," and "mounted" and variations thereof herein are used in the disclosure (including the claims) broadly and encompass direct and indirect connections, couplings, and mountings. For example, if the disclosure describes a first apparatus being coupled to a second apparatus, then it should be interpreted that the first apparatus may be directly coupled to the second apparatus, or that the first apparatus may be indirectly coupled to the second apparatus through another apparatus or a certain coupling mechanism.

Figure 1:
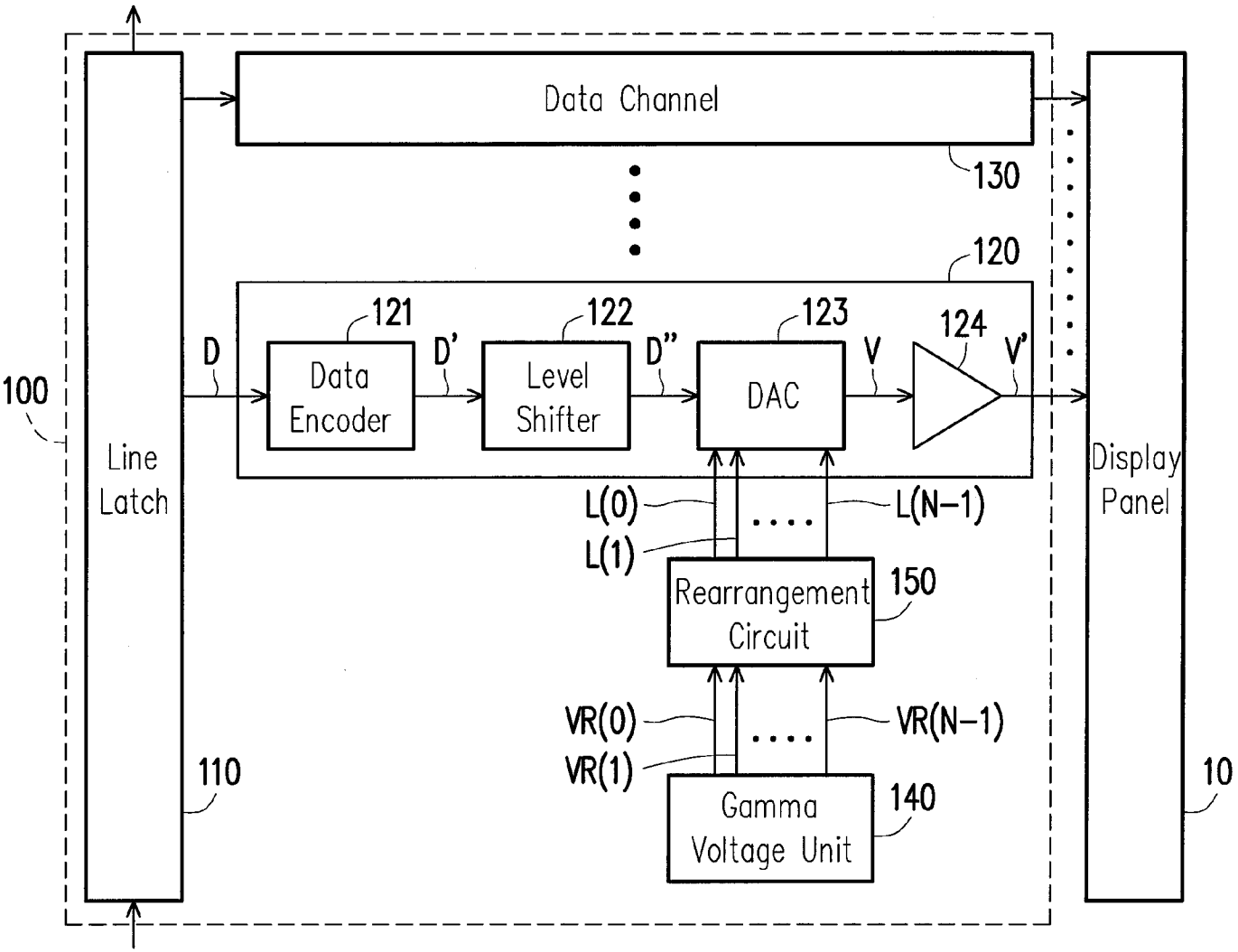
FIG. 1 is a circuit block diagram of a panel driver integrated circuit (IC) according to an embodiment of the invention.

FIG. 1 is a circuit block diagram of a panel driver integrated circuit (IC) 100 according to an embodiment of the invention. A line latch 110 of the panel driver IC 100 receives and latches the pixel data provided by a prior stage circuit (e.g. a timing controller or another panel driver IC) according to the timing controller (not drawn). Moreover, according to timing controller, the line latch 110 respectively outputs the pixel data of different channels latched in the line latch 110 to different data channels (e.g., the data channels 120 and 130 depicted in FIG. 1). According to N reference voltages (gamma voltages) VR(0), VR(1), . . . , VR(N−1) having different voltage levels, the data channels 120 to 130 respectively convert the digital pixel data of the line latch 110 to analog drive voltages. Furthermore, the output terminals of the data channels 120 to 130 are respectively coupled to different data lines of a display panel 10. Therefore, the data channels 120 to 130 output analog drive voltages to the display panel 10.

Although FIG. 1 only illustrated details of the data channel 120, other data channels (e.g. the data channel 130) can be deduced by reference to the description of the data channel 120. In the data channel 120, a data encoder 121 is coupled to the line latch 110 to receive a pixel data D outputted from the line latch 110, and to output a pixel data D' to a level shifter 122. The level shifter 122 is coupled to the data encoder 121 to receive the pixel data D' outputted from the data encoder 121, and to adjust the voltage level of the pixel data D' (e.g., ramping the signal level to high voltage level). An output terminal of the level shifter 122 is coupled to a data input terminal of a digital-to-analog converter (DAC) 123, so as to output a pixel data D" after the voltage level adjustment to the DAC 123.

A rearrangement circuit 150 has a plurality of output terminals coupled to the input terminals of a plurality of reference voltages of the DAC 123, so as to provide N reference voltages VR(0)-VR(N−1), in which N is a positive integer. The rearrangement circuit 150 rearranges an order of the reference voltages VR(0)-VR(N−1) from the gamma voltage unit 140 according to an encoding operation of the data encoder 121. Moreover, the rearrangement circuit 150 respectively transmits the rearranged reference voltages VR(0)-VR(N−1) to different reference voltage input terminals of the DAC 123 through the conductive lines L(0), L(1), . . . , L(N−1). The DAC 123 of the data channel 120 converts the digital pixel data D" from the level shifter 122 to an analog drive voltage V according to the reference voltages VR(0)-VR(N−1) from the gamma voltage unit 140. In other words, the DAC 123 selects the reference voltage (gamma voltage) corresponding to the pixel data D" from the rearranged reference voltages VR(0)-VR(N−1), and outputs the selected reference voltage as the drive voltage V. An input terminal of the output buffer 124 is coupled to the output terminal of the DAC 123, and an output terminal of the output buffer 124 is coupled to a corresponding data line of the display panel 10. The output buffer 124 receives and amplifies the drive voltage V, and the output buffer 124 transmits an amplified gain voltage V' to the display panel 10.

As an example, assume a temperature function of the panel driver IC 100 is $\Sigma_1^{CH}T(\Delta D, \Delta V_{OUT})$. Moreover, assuming the waste heat of the level shifter 122 and the waste heat of the output buffer 124 are mutually independent, then $\Sigma_1^{CH}T(\Delta D, \Delta V_{OUT})=\Sigma_1^{CH}T_{lvs}(\Delta D)+\Sigma_1^{CH}T_{buffer}(\Delta V_{OUT})$, in which $\Sigma_1^{CH}T_{lvs}(\Delta D)$ is the temperature variation contributed by the level shifter 122, and $\Sigma_1^{CH}T_{buffer}(\Delta V_{OUT})$ is the temperature variation contributed by the output buffer 124. CH is the number of data channels in the driver IC 100, ΔD describes the data transitions of the level shifter 122, and $\Delta V_{OUT}$ describes the voltage transitions of the output buffer 124. The data transition pattern ΔD refers to the output of the level shifter 122 transitioning from the previous pixel data D" to the current pixel data D". If the pixel data is 8 bits, then the data transition pattern ΔD has 256*256=65536 variations. The voltage transition pattern $\Delta V_{OUT}$ refers to the output of the output buffer 124 transitioning from the previous grayscale voltage V' to the current grayscale voltage V'.

Figure 2:
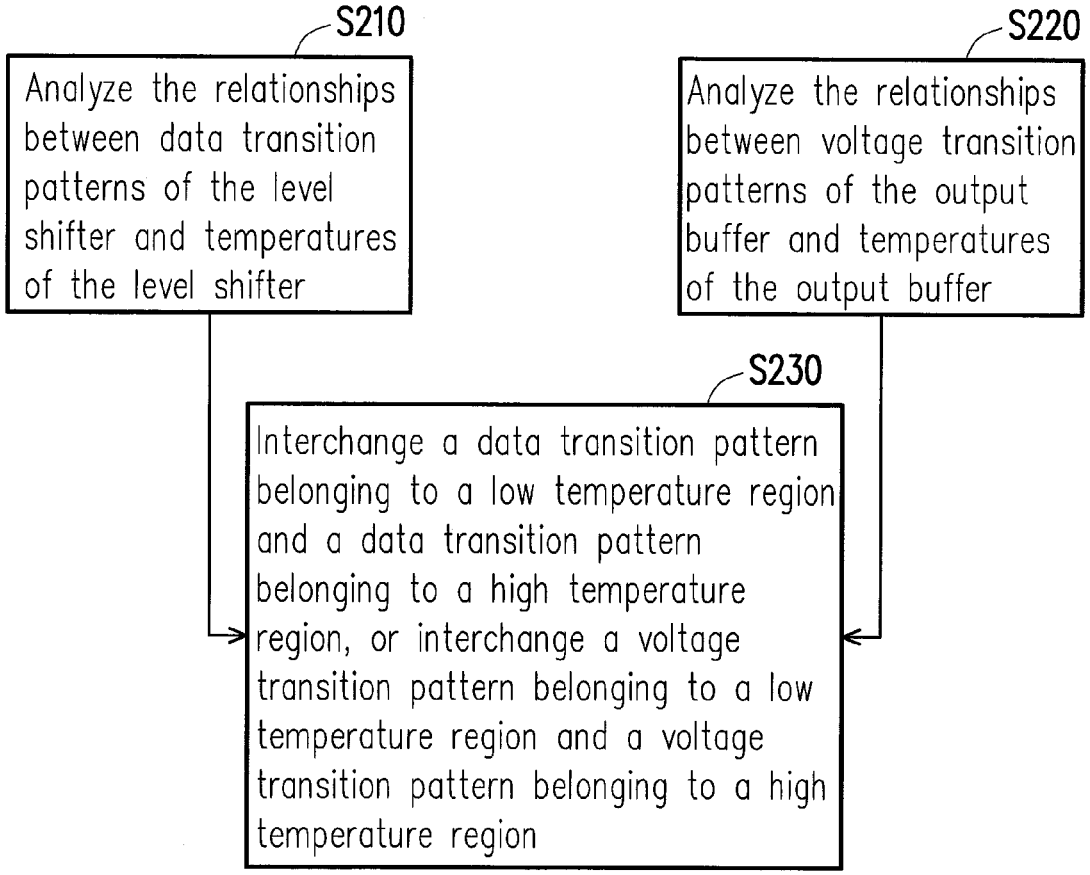
FIG. 2 is a flow diagram of a cooling method of a panel driver IC according to an embodiment of the invention.

FIG. 2 is a flow diagram of a cooling method of a panel driver IC according to an embodiment of the invention. Step S210 analyzes/compiles statistics on the relationships between different data transition patterns ΔD and different temperatures $\Sigma_1^{CH}T_{lvs}(\Delta D)$ of the level shifter 122 in the panel driver IC 100. Using 8 bits as an example, the data transition pattern ΔD may represent a previous pixel data 00001100 (i.e. 12) transitioning to a current pixel data 00010000 (i.e. 16). Alternatively, the data transition patterns ΔD may represent a previous pixel data 10000000 (i.e. 128) transitioning to a current pixel data 00000110 (i.e. 6).

Figures 3A, 3B:
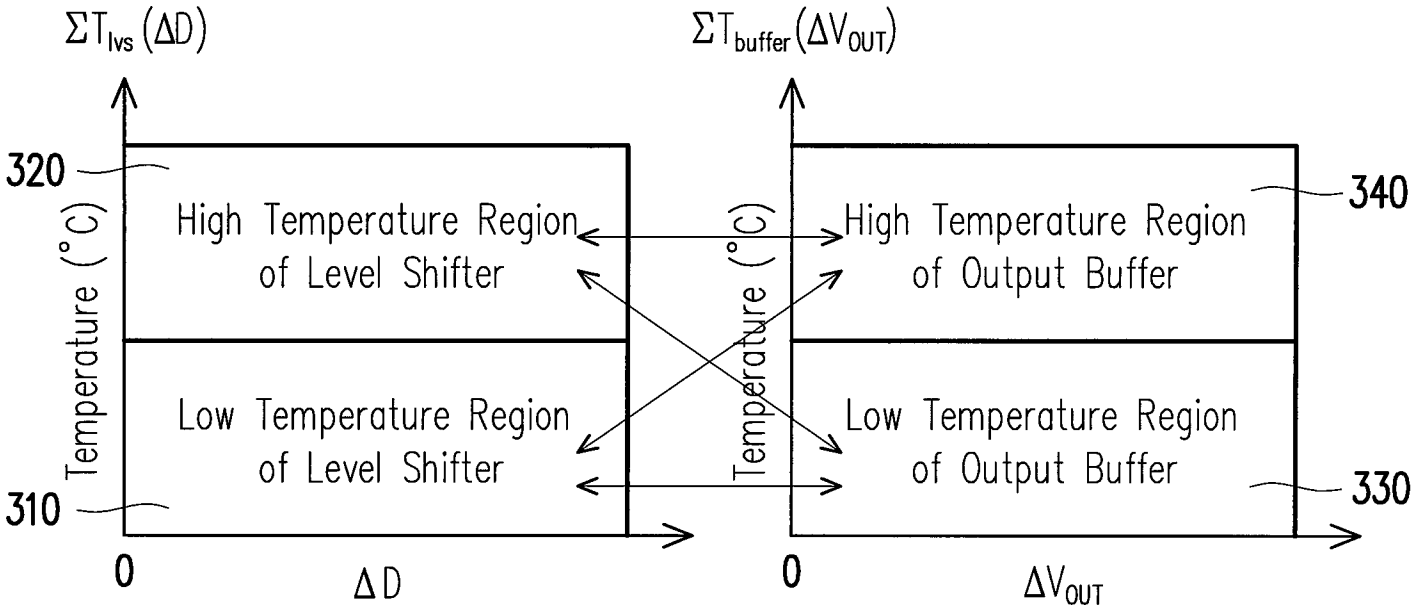
FIG. 3A is a diagram depicting the relationships between different data transition patterns ΔD and temperatures $\Sigma_1{}^{CH}T_{lvs}(\Delta D)$ of the level shifter after analysis/statistical compilation according to an embodiment of the invention.
FIG. 3B is a diagram depicting the relationships between different voltage transition patterns $\Delta V_{OUT}$ and temperatures $\Sigma_1{}^{CH}T_{buffer}(\Delta V_{OUT})$ of the output buffer after analysis/statistical compilation according to an embodiment of the invention.

FIG. 3A is a diagram depicting the relationships between different data transition patterns ΔD and temperatures $\Sigma_1^{CH}T_{lvs}(\Delta D)$ of the level shifter after the analysis/statistical compilation of Step S210 according to an embodiment of the invention. The vertical axis of FIG. 3A represents the temperature $\Sigma_1^{CH}T_{lvs}(\Delta D)$ of the level shifter, and the horizontal axis represents the data transition pattern ΔD. The temperature $\Sigma_1^{CH}T_{lvs}(\Delta D)$ of the level shifter shown in FIG. 3A is divided into a high temperature region 320 and a low temperature region 310. When an input bit of the level shifter 122 changes from 0 to 1 (or from 1 to 0), the bias voltage point of each transistor in the circuit needs to change, and the power consumption during this transition time is enormous. Accordingly, the chip temperature rises noticeably. For example, assuming the data transition pattern ΔD of the level shifter 122 transitions from 00000000 to 11111111 (i.e. 255), since 8 bits have been changed, the temperature $\Sigma_1^{CH}T_{lvs}(\Delta D)$ of the level shifter for the 00000000 to 11111111 transition belongs to the high temperature region 320. Therefore, the heat energy generated by the level shifter 122 transitioning from 00000000 to 11111111 is large. On the other hand, assuming the data transition pattern ΔD of the level shifter 122 transitions from 00000000 to 00000001, since only 1 bit has been changed, the temperature $\Sigma_1^{CH}T_{lvs}(\Delta D)$ of the level shifter for the 00000000 to 00000001 transition belongs to the low temperature region 310. Accordingly, the heat energy generated by the level shifter 122 transitioning from 00000000 to 00000001 is large.

Step S220 shown in FIG. 2 analyzes/compiles statistics on the relationships between different voltage transition patterns $\Delta V_{OUT}$ and different temperatures $\Sigma_1^{CH}T_{buffer}(\Delta V_{OUT})$ the output buffer 124 in the panel driver IC 100. For example, the voltage transition pattern $\Delta V_{OUT}$ may represent a previous reference voltage VR(12) transitioning to a current reference voltage VR(16). Alternatively, the voltage transition pattern $\Delta V_{OUT}$ may represent a previous reference voltage VR(128) transitioning to a current reference voltage VR(6).

FIG. 3B is a diagram depicting the relationships between different voltage transition patterns $\Delta V_{OUT}$ and temperatures $\Sigma_1^{CH}T_{buffer}(\Delta V_{OUT})$ of the output buffer after the analysis/statistical compilation of Step S220 according to an embodiment of the invention. The vertical axis of FIG. 3B represents the temperature $\Sigma_1^{CH}T_{buffer}(\Delta V_{OUT})$ of the output buffer, and the horizontal axis represents the voltage transition pattern $\Delta V_{OUT}$. The temperature $\Sigma_1^{CH}T_{buffer}(\Delta V_{OUT})$ of the output buffer shown in FIG. 3B is divided into a high temperature region 340 and a low temperature region 330. When the input of the output buffer 124 changes from low voltage to high voltage (or from high voltage to low voltage), the output buffer 124 charges (or discharges) the display panel 10 a considerable amount. Therefore, the power consumption during this transition time is large, and the chip temperature drastically rises. For example, assuming the voltage transition pattern $\Delta V_{OUT}$ of the output buffer 124 transitions from a reference voltage VR(0) to a reference voltage VR(255), since an output voltage swing of the output buffer 124 is 255 gray levels, the temperature $\Sigma_1^{CH}T_{buffer}(\Delta V_{OUT})$ of the transition from the reference voltage VR(0) to the reference voltage VR(255) belongs to the high temperature 340. Therefore, the heat energy generated by the output buffer 124 transitioning from the reference voltage VR(0) to the reference voltage VR(255) is large. Moreover, assuming the voltage transition pattern $\Delta V_{OUT}$ of the output buffer 124 transitions from the reference voltage VR(0) to a reference voltage VR(1), since the output voltage swing of the output buffer 124 is only one gray level, the temperature $\Sigma_1^{CH}T_{buffer}(\Delta V_{OUT})$ of the transition from the reference voltage VR(0) to the reference voltage VR(1) belongs to the low temperature 330. Therefore, the heat energy generated by the output buffer 124 transitioning from the reference voltage VR(0) to the reference voltage VR(1) is small.

The double arrow lines between FIGS. 3A and 3B represent the corresponding relationships between the data transition pattern ΔD and voltage transition pattern $\Delta V_{OUT}$ of the panel driver IC 100, when the cooling method depicted in FIG. 2 has not been implemented. For example, assuming the DAC 123 respectively converts the pixel data 00000000 and 00000001 to the reference voltages VR(0) and VR(1), then the data transition pattern ΔD of "00000000 to 00000001" belonging to the low temperature region 310 has a corresponding relationship with the voltage transition pattern $\Delta V_{OUT}$ of "VR(0) to VR(1)" belonging to the low temperature region 330. In another example, assuming the DAC 123 respectively converts the pixel data 00000000 and 11000000 to the reference voltages VR(0) and VR(192), then the data transition pattern ΔD of "00000000 to 11000000" belonging to the low temperature region 310 has a corresponding relationship with the voltage transition pattern $\Delta V_{OUT}$ of "VR(0) to VR(192)" belonging to the high temperature region 340. In another example, assuming the DAC 123 respectively converts the pixel data 01111111 and 10000000 to the reference voltages VR(127) and VR(128), then the data transition pattern ΔD of "01111111 to 10000000" belonging to the high temperature region 320 has a corresponding relationship with the voltage transition pattern $\Delta V_{OUT}$ of "VR(127) to VR(128)" belonging to the low temperature region 330.

As another example, assuming the DAC 123 respectively converts the pixel data 00000000 and 11111111 to the reference voltages VR(0) and VR(255), then the data transition pattern ΔD of "00000000 to 11111111" belonging to the high temperature region 320 has a corresponding relationship with the voltage transition pattern $\Delta V_{OUT}$ of "VR(0) to VR(255)" belonging to the high temperature region 340. When the level shifter 122 and the output buffer 124 are both operating at the high temperature region 320 and the high temperature region 340, the temperature of the panel driver IC 100 drastically rises. The high temperature may alter the characteristics of the panel driver IC 100 and lower the reliability, for example. If the corresponding relationships between the data transition pattern ΔD and the voltage transition pattern $\Delta V_{OUT}$ can be adjusted, such that no corresponding relationships exist between the high temperature regions 320 and 340, then the temperature of the panel driver IC 100 can be effectively lowered.

By using the data encoder 121 and the rearrangement circuit 150, Step S230 depicted in FIG. 2 can interchange a data transition pattern ΔD belonging to the low temperature region 310 and a data transition pattern ΔD belonging to the high temperature region 320, or interchange a voltage transition pattern $\Delta V_{OUT}$ belonging to the low temperature region 330 and a voltage transition pattern $\Delta V_{OUT}$ belonging to the high temperature region 340. Accordingly, no corresponding relationships would exist between the high temperature regions 320 and 340. For example, assume that first transitions belonging to the high temperature region 320 and second transitions belonging to the low temperature region 310 are included in a plurality of data transition patterns ΔD.

Moreover, assume that third transitions belonging to the low temperature region 330 and fourth transitions belonging to the low temperature region 330 are included in a plurality of voltage transition patterns $\Delta V_{OUT}$. If the first transitions and the third transitions have a corresponding relationship, then Step S230 can use the second transitions belonging to the low temperature region 310 to exchange/replace the first transitions belonging to the high temperature region 320. The corresponding relationship is adjusted to be established between the second transitions belonging to the low temperature region 310 and the third transitions belonging to the high temperature region 340. Alternatively, Step S230 can use the fourth transitions belonging to the low temperature region 330 to exchange/replace the third transitions belonging to the high temperature region 340. The corresponding relationship is adjusted to be established between the fourth transitions belonging to the low temperature region 330 and the first transitions belonging to the high temperature region 320.

Figure 4:
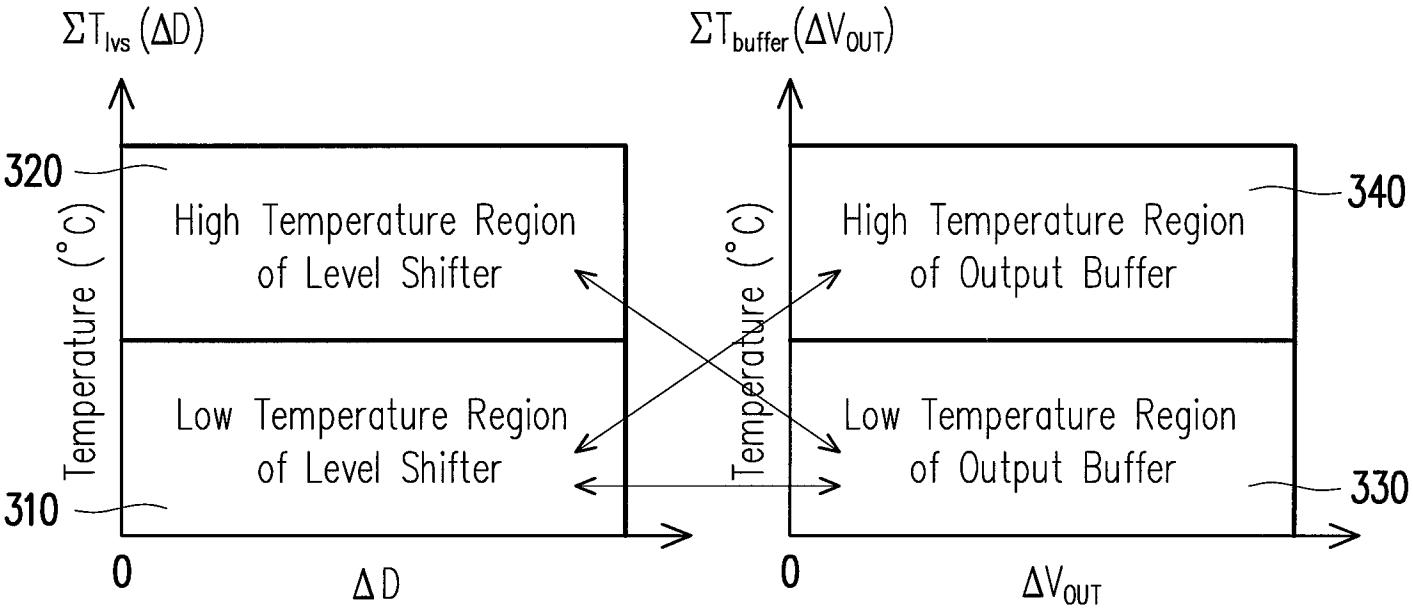
FIG. 4 is a diagram depicting corresponding relationships between data transition patterns ΔD and voltage transition patterns $\Delta V_{OUT}$ according to an embodiment of the invention, after the relationships between data transition patterns ΔD and voltage transition patterns $\Delta V_{OUT}$ have been adjusted.

FIG. 4 is a diagram depicting corresponding relationships between data transition patterns ΔD and voltage transition patterns $\Delta V_{OUT}$ according to an embodiment of the invention, after the relationships between data transition patterns ΔD and voltage transition patterns $\Delta V_{OUT}$ have been adjusted. After Step S230 is completed, no corresponding relationships exist between data transition patterns ΔD belonging to the high temperature region 320 and voltage transition patterns $\Delta V_{OUT}$ belonging to the high temperature region 340, and therefore the temperature of the panel driver IC 100 can be effectively lowered.

Figure 5:
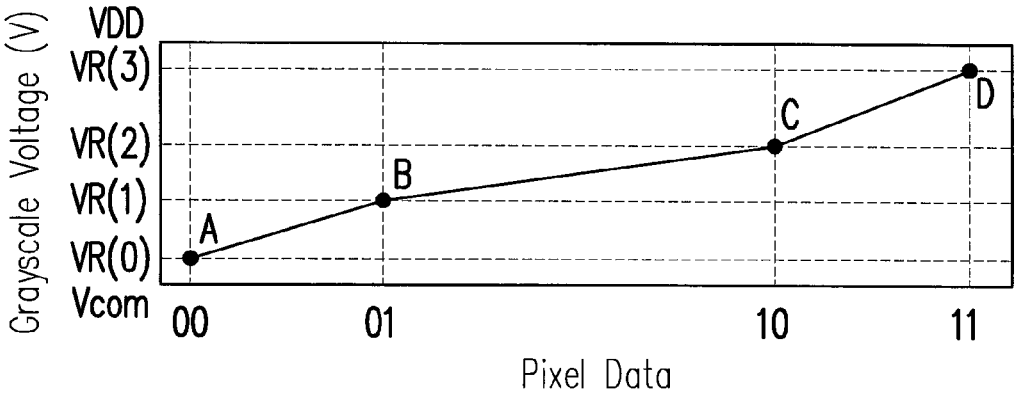
FIG. 5 is a gamma curve of a 2-bit data according to an embodiment of the invention.

It is assumed that the pixel data D inputted in the panel driver IC 100 is a 2-bit data, for example. FIG. 5 is a gamma curve of a 2-bit pixel data according to an embodiment of the invention. The vertical axis of FIG. 5 represents the grayscale voltage V (or V'), and the horizontal axis represents the pixel data D (or D"). The 2-bit data has a total of four variations: 00, 01, 10 (i.e. 2) and 11 (i.e. 3), and the data transition patterns ΔD have 4*4=16 variations. If "a-b" represents a data transition pattern ΔD from a previous pixel data a to a current pixel data b, then the data transition patterns ΔD include "0-0", "0-1", "0-2", "0-3", "1-0", "1-1", "1-2", "1-3", "2-0", "2-1", "2-2", "2-0.3", "3-0", "3-1", "3-2" and "3-3".

Figure 6:
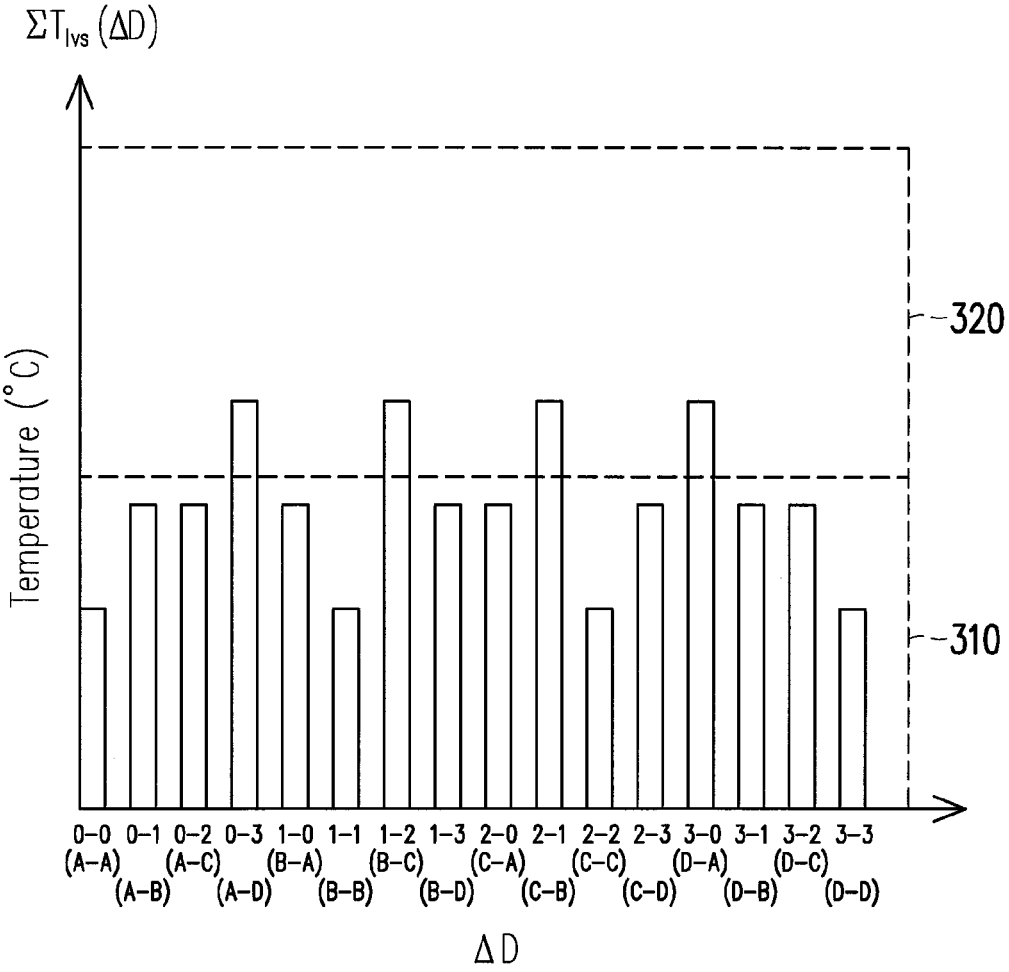
FIG. 6 is a diagram depicting the relationships between temperatures $\Sigma_1^{CH}T_{lvs}(\Delta D)$ of the level shifter and data transition patterns ΔD of the level shifter according to an embodiment of the invention, before the cooling method of FIG. 2 is implemented.

It is assumed that the output load of each bit of the level shifter 122 is the same. FIG. 6 is a diagram depicting the relationships between temperatures $\Sigma_1{}^{CH}T_{lvs}(\Delta D)$ of the level shifter and data transition patterns ΔD of the level shifter according to an embodiment of the invention, before the cooling method of FIG. 2 is implemented. The related description of FIG. 3A may be referred to for FIG. 6. The vertical axis of FIG. 6 represents the temperature $\Sigma_1{}^{CH}T_{lvs}(\Delta D)$ of the level shifter, and the horizontal axis represents the data transition pattern ΔD. FIG. 6 may also represent the power consumption contributed by the transition bits of the level shifter 122. As shown in FIG. 6, when the data transition pattern ΔD is "0-0", "1-1", "2-2" and "3-3", since no bit transition has occurred in the output of the level shifter 122, the temperature $\Sigma_1{}^{CH}T_{lvs}(\Delta D)$ of the level shifter is at the lowest. Therefore, data transition patterns ΔD such as "0-0", "1-1", "2-2" and "3-3" belong to the low temperature region 310. When the data transition patterns ΔD are "0-1", "0-2", "1-0", "1-3", "2-0", "2-3", "3-1" and "3-2", since only one bit has transitioned in the output of the level shifter 122, the temperatures $\Sigma_1{}^{CH}T_{lvs}(\Delta D)$ of the level shifter are higher, but they still belong to the low temperature region 310. When the data transition patterns AD are "0-3", "1-2", "2-1" and "3-0", since a transition has occurred for all of the bits in the output of the level shifter 122, the temperatures $\Sigma_1{}^{CH}T_{lvs}(\Delta D)$ of the level shifter are at the highest. Therefore, data transition patterns ΔD such as "0-3", "1-2", "2-1" and "3-0" belong to the high temperature region 320.

After conversion by the data channel 120, the four variations of the 2-bit pixel data D respectively correspond to points A, B, C and D of the gamma curve shown in FIG. 5. Therefore, the voltage transition pattern $\Delta V_{OUT}$ has a total of 16 combinations. If "a-b" represents a voltage transition pattern $\Delta V_{OUT}$ of a previous grayscale voltage a transitioning a current grayscale voltage b, then the voltage transition patterns $\Delta V_{OUT}$ include "A-A", "A-B", "A-C", "A-D", "B-A", "B-B", "B-C", "B-D", "C-A", "C-B", "C-C", "C-D", "D-A", "D-B", "D-C" and "D-D".

Figure 7:
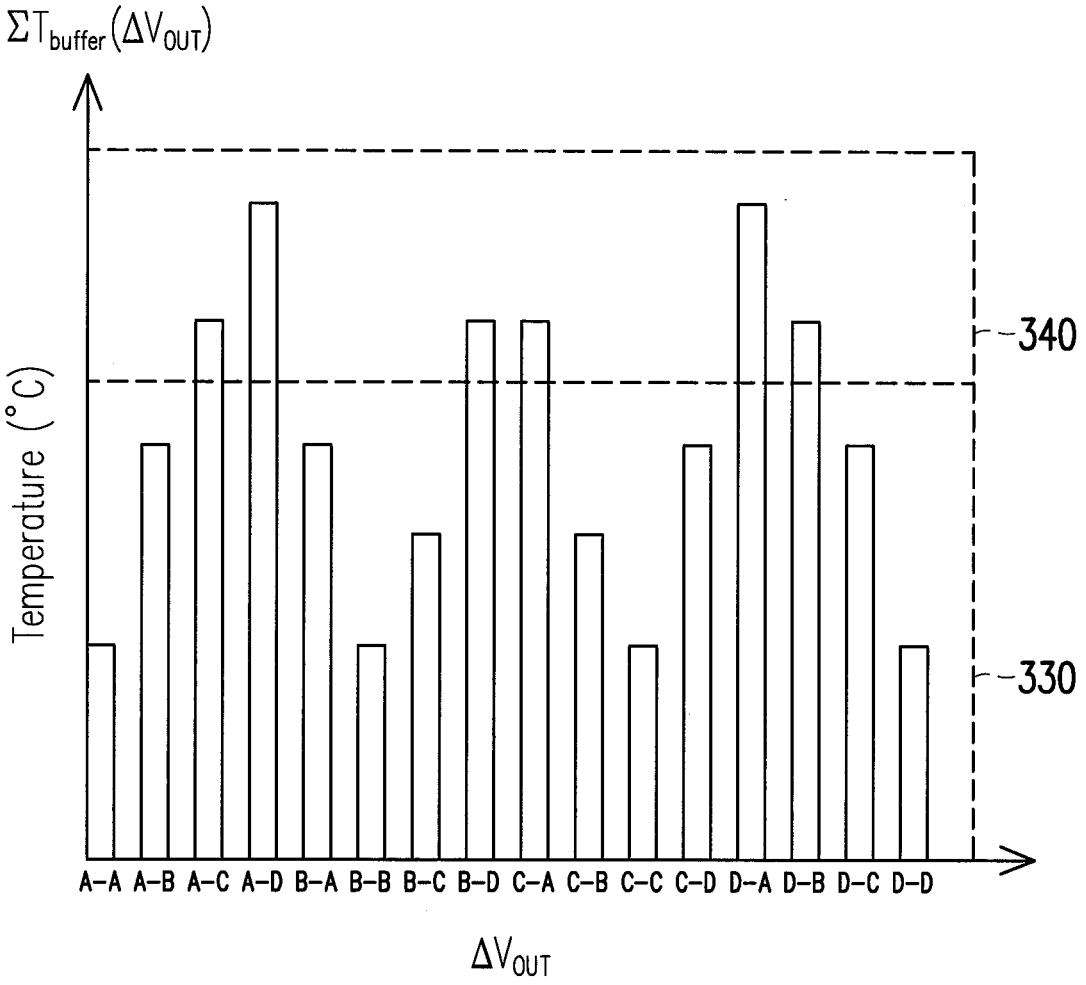
FIG. 7 is a diagram depicting the relationships between temperatures $\Sigma_1^{CH}T_{buffer}(\Delta V_{OUT})$ of the output buffer and voltage transition patterns $\Delta V_{OUT}$ according to an embodiment of the invention.

It is assumed that the power consumption of the output buffer 124 is only related to the output waveforms, for example. FIG. 7 is a diagram depicting the relationships between temperatures $\Sigma_1{}^{CH}T_{buffer}(\Delta V_{OUT})$ of the output buffer and voltage transition patterns $\Delta V_{OUT}$ according to an embodiment of the invention. The related description of FIG. 3B may be referred to for FIG. 7. The vertical axis of FIG. 7 represents the temperature $\Sigma_1{}^{CH}T_{buffer}(\Delta V_{OUT})$ of the output buffer, and the horizontal axis represents the voltage transition pattern $\Delta V_{OUT}$. FIG. 7 may also represent the power consumption contributed by the output buffer 124. As shown in FIG. 7, when the voltage transition patterns $\Delta V_{OUT}$ are "A-A", "B-B", "C-C" and "D-D", since the output voltage level of the output buffer 124 has not changed, the temperature $\Sigma_1{}^{CH}T_{buffer}(\Delta V_{OUT})$ of the output buffer is at the lowest. Therefore, voltage transition patterns $\Delta V_{OUT}$ such as "A-A", "B-B", "C-C" and "D-D" belong to the low temperature region 330. When the voltage transition patterns $\Delta V_{OUT}$ are "B-C" and "C-B", since the output voltage swing of the output buffer 124 is the smallest, the temperature $\Sigma_1{}^{CH}T_{buffer}(\Delta V_{OUT})$ of the output buffer still belongs to the low temperature region 330. When the voltage transition patterns $\Delta V_{OUT}$ are "A-B", "B-A", "C-D" and "D-C", since the output voltage swing of the output buffer 124 is one gray level, the temperature $\Sigma_1{}^{CH}T_{buffer}(\Delta V_{OUT})$ of the output buffer still belongs to the low temperature region 330. When the voltage transition patterns $\Delta V_{OUT}$ are "A-C", "B-D", "C-A" and "D-B", the output voltage swing of the output buffer 124 is two gray levels. When the voltage transition patterns $\Delta V_{OUT}$ are "A-D" and "D-A", since the output voltage swing of the output buffer 124 is three gray levels, the temperature $\Sigma_1{}^{CH}T_{buffer}(\Delta V_{OUT})$ of the output buffer is at the highest. Therefore, voltage transition patterns $\Delta V_{OUT}$ such as "A-C", "A-D", "B-D", "C-A", "D-A" and "D-B" belong to the high temperature region 340.

As shown by FIGS. 6 and 7, when the cooling method of FIG. 2 has not been implemented, the data transition patterns ΔD such as "0-3" and "3-0" belonging to the high temperature region 320 and the voltage transition patterns $\Delta V_{OUT}$ such as "A-D" and "D-A" belonging to the high temperature region 340 have a corresponding relationship. When the level shifter 122 and the output buffer 124 are both operating at the high temperature region 320 and the high temperature region 340, the temperature of the panel driver IC 100 drastically rises. If the corresponding relationships between the data transition patterns ΔD and the voltage transition patterns $\Delta V_{OUT}$ can be adjusted, such that no corresponding relationships exist between the high temperature regions 320 and 340, then the temperature of the panel driver IC 100 can be effectively lowered. For example, the data transition patterns ΔD belonging to the low temperature region 310 and the data transition patterns ΔD belonging to the high temperature region 320 can be interchanged.

Figure 8:
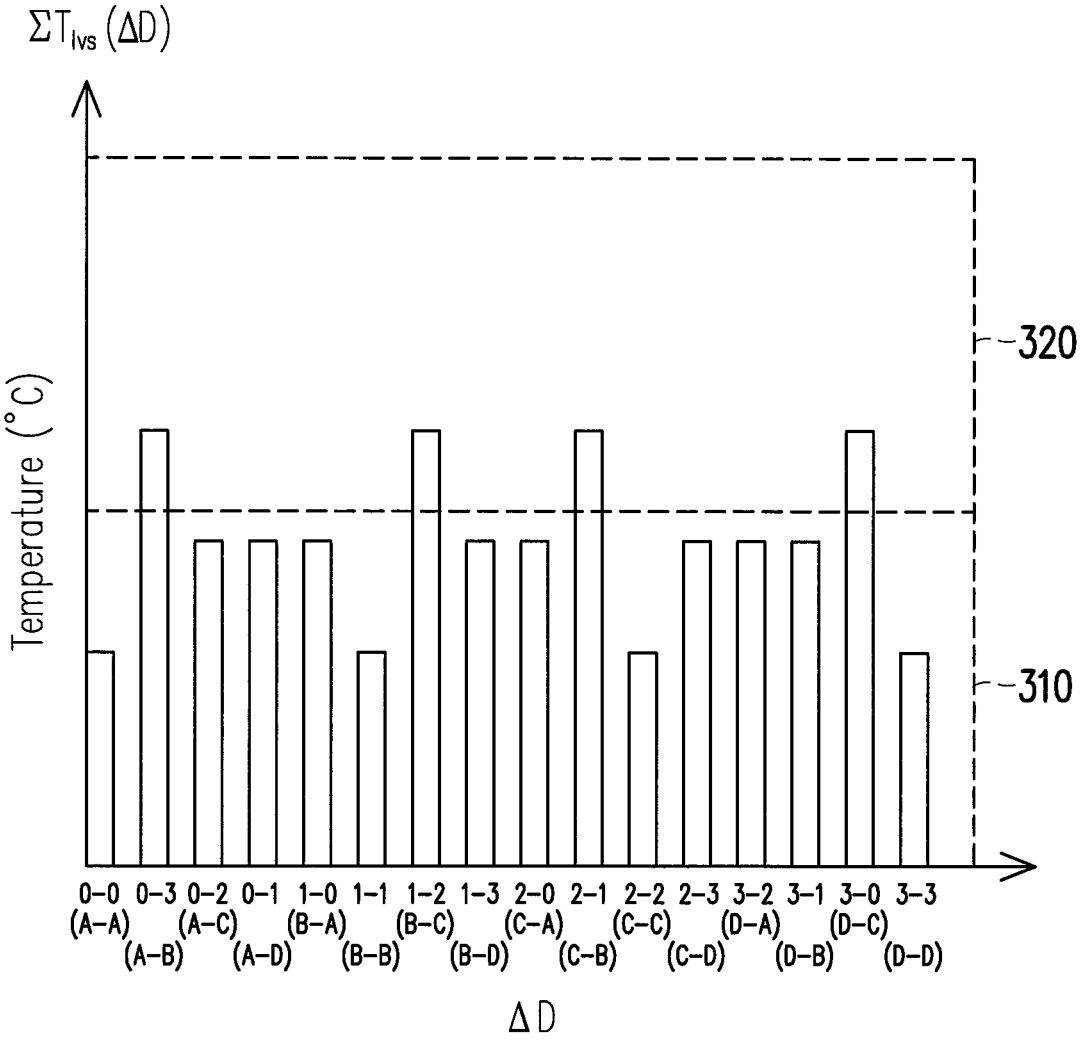
FIG. 8 is a diagram depicting the relationships between data transition patterns ΔD and temperatures $\Sigma_1^{CH}T_{lvs}(\Delta D)$ of the level shifter according to an embodiment of the invention, after the corresponding relationships between data transition patterns ΔD and voltage transition patterns $\Delta V_{OUT}$ have been adjusted.

FIG. 8 is a diagram depicting the relationships between data transition patterns ΔD and temperatures $\Sigma_1^{CH}T_{lvs}(\Delta D)$ of the level shifter according to an embodiment of the invention, after the corresponding relationships between data transition patterns ΔD and voltage transition patterns $\Delta V_{OUT}$ have been adjusted. The related description of FIGS. 3A and 6 may be referred to for FIG. 8. A difference with the embodiment illustrated in FIG. 6 is that, in the embodiment shown in FIG. 8, the data encoder 121 and the rearrangement circuit 150 are used to interchange two data transition patterns ΔD of "0-1" and "0-3", and to interchange two data transition patterns AD of "3-1" and "3-2".

For example, with reference to FIG. 1, when the original pixel data D transitions from 00 to 11 (i.e. 3), the data encoder 121 selectively performs an encoding operation, such that the original data 11 is changed to 01 to serve as the pixel data D'. When the data encoder 121 performs the encoding operation, the rearrangement circuit 150 simultaneously rearranges an order of the reference voltages VR(0)-VR(3), and the order may be VR(0), VR(3), VR(2) and VR(1), for example. At this time, according to the pixel data D" (i.e. 01), the DAC 123 selectively outputs the corresponding reference voltage VR(3) to serve as the drive voltage V. Therefore, as shown in FIG. 8, when the output buffer 124 operates in the high temperature region 340 (due to the reference voltage VR(0) transitioning to VR(3)), the level shifter 122 is operating in the low temperature region 310 (since the pixel data 00 transitions to 01). Similarly, when the original pixel data D transitions from 00 to 01, the data encoder 121 selectively performs an encoding operation, such that the original data 01 is changed to 11 to serve as the pixel data D'.

When the original pixel data D transitions from 11 to 00, the data encoder 121 selectively performs an encoding operation, such that the original data 00 is changed to 10 to serve as the pixel data D'. When the data encoder 121 performs the encoding operation, the rearrangement circuit 150 simultaneously rearranges an order of the reference voltages VR(0)-VR(3), and the order may be VR(2), VR(1), VR(0) and VR(3), for example. At this time, according to the pixel data D" (i.e. 10), the DAC 123 selectively outputs the corresponding reference voltage VR(0) to serve as the drive voltage V. Therefore, as shown in FIG. 8, when the output buffer 124 operates in the high temperature region 340 (due to the reference voltage VR(3) transitioning to VR(0)), the level shifter 122 is operating in the low temperature region 310 (since the pixel data 00 transitions to 01). Similarly, when the original pixel data D transitions from 11 to 00, the data encoder 121 selectively performs an encoding operation, such that the original data 10 is changed to 00 to serve as the pixel data D'.

As shown in FIG. 8, when the original pixel data D transitions from 00 to 11 (i.e. 3), the data encoder 121 changes the original data 11 to 01 to serve as the pixel data D'. When the original pixel data D transitions from 00 to 11, the data encoder 121 changes the original data 01 to 11 to serve as the pixel data D'. When the original pixel data D transitions from 11 to 00, the data encoder 121 changes the original data 00 to 10 to serve as the pixel data D'. When the original pixel data D transitions from 11 to 00, the data encoder 121 changes the original data 10 to 00 to serve as the pixel data D'. The data encoder 121 does not perform the encoding operation besides the aforementioned. When the data encoder 121 does not perform the encoding operation, the rearrangement circuit 150 also simultaneously does not perform the rearrangement operation, and the order of the reference voltages VR(0)-VR(3) returns to VR(0), VR(1), VR(2) and VR(3).

As described above, by changing the corresponding relationships between the data transition patterns ΔD of the level shifter 122 and the voltage transition patterns $\Delta V_{OUT}$ of the output buffer 124, the present embodiment can reduce the temperature of the panel driver IC 100.

In another embodiment, with reference to FIG. 1, the data encoder 121 receives an original pixel data D and performs an encoding operation, in which the encoding operation changes the original pixel data D to serve as an output pixel data D' of the data encoder 121 according to a data mapping table. The data encoder 121 can change the output data (i.e. pixel data D') of the level shifter 122 according to the data mapping table. The rearrangement circuit rearranges an order of the reference voltages VR(0)-VR(N−1) of the DAC 123 according to the encoding operation of the data mapping table.

Figure 9:
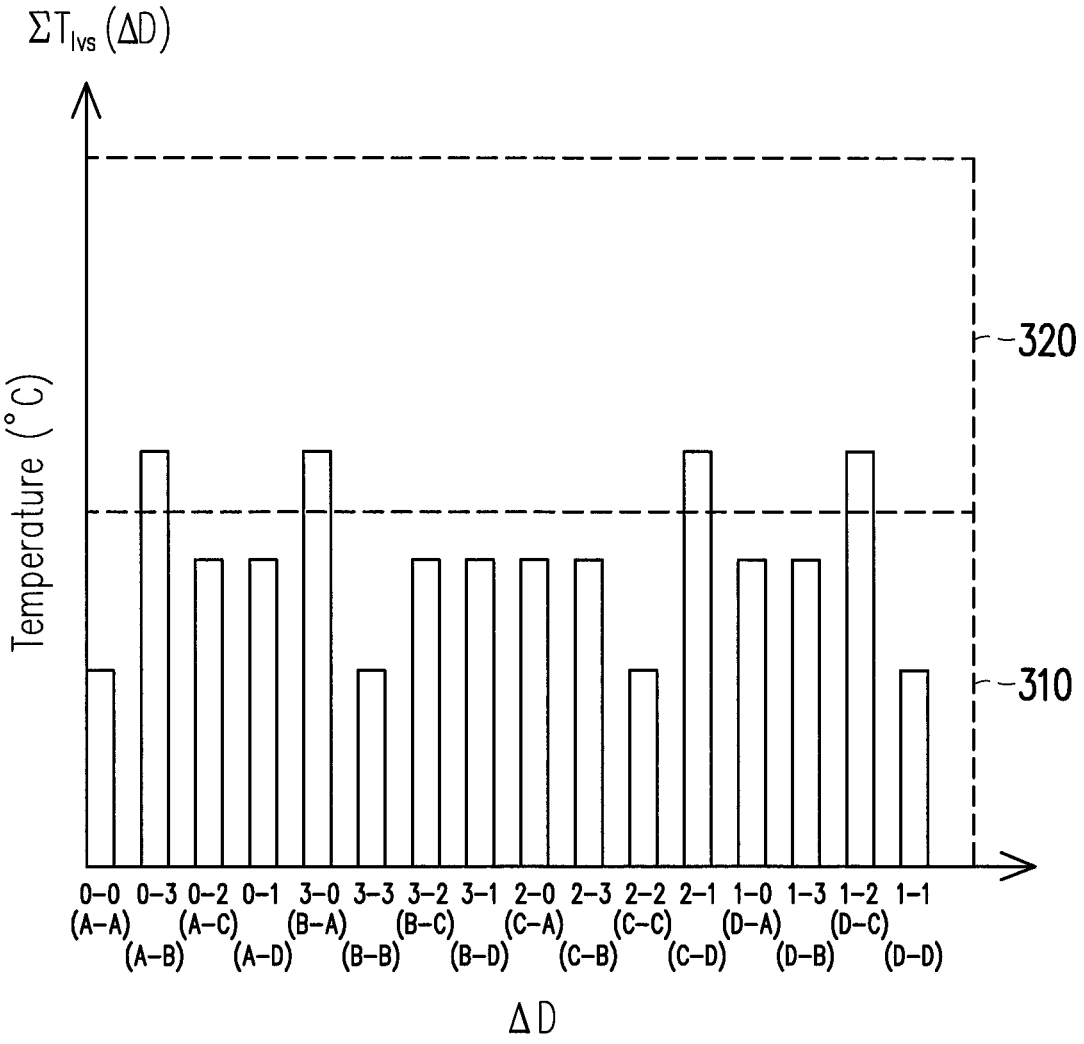
FIG. 9 is a diagram depicting the relationships between data transition patterns ΔD and temperatures $\Sigma_1^{CH}T_{lvs}(\Delta D)$ of the level shifter according to another embodiment of the invention, after the corresponding relationships between data transition patterns ΔD and voltage transition patterns $\Delta V_{OUT}$ have been adjusted.

For example, FIG. 9 is a diagram depicting the relationships between data transition patterns ΔD and temperatures $\Sigma_1^{CH}T_{lvs}(\Delta D)$ of the level shifter according to another embodiment of the invention, after the corresponding relationships between data transition patterns ΔD and voltage transition patterns $\Delta V_{OUT}$ have been adjusted. FIG. 9 may be deduced by referring to the related description of FIGS. 3A, 6 and 8. With reference to the embodiments shown in FIGS. 5-8, the embodiment depicted in FIG. 9 also assumes the pixel data of the panel driver IC 100 in FIG. 1 is a 2-bit data. Table 1 is a data mapping table of the data encoder 121 shown in FIG. 1 according to the embodiment depicted in FIG. 9. A difference from the embodiment depicted in FIG. 8 is that, no matter what the pixel data D is, the data encoder 121 in the embodiment depicted in FIG. 9 continually performs the encoding operation according to the data mapping table of Table 1.

TABLE 1

Data Mapping Table of Data Encoder 121

| Original Pixel Data D (decimal) | Original Pixel Data D (binary) | Output Pixel Data D' (binary) |
|---|---|---|
| 0 | 00 | 00 |
| 1 | 01 | 11 |
| 2 | 10 | 10 |
| 3 | 11 | 01 |

Table 2 is a rearrangement table of the rearrangement circuit 150 according to the embodiment depicted in FIG. 9. According to the encoding operation performed by the data encoder 121 using the data mapping table of Table 1, the rearrangement circuit 150 in the embodiment of FIG. 9 continually performs the rearrangement operation according to the rearrangement table of Table 2. For example, when the original pixel data D is 00, the data encoder 121 directly outputs 00 to serve as the pixel data D', and therefore the DAC 123 selects the reference voltage VR(0) of the conductive line L(0) to serve as the drive voltage V according to the pixel data D" (i.e. 00). When the original pixel data D is 01, the data encoder 121 changes the original data 01 to 11 to serve as the pixel data D', and therefore the DAC 123 selects the reference voltage VR(1) of the conductive line L(3) to serve as the drive voltage V according to the pixel data D" (i.e. 11). When the original pixel data D is 10 (i.e. 2), the data encoder 121 directly outputs 10 to serve as the pixel data D', and therefore the DAC 123 selects the reference voltage VR(2) of the conductive line L(2) to serve as the drive voltage V according to the pixel data D" (i.e. 10). When the original pixel data D is 11 (i.e. 3), the data encoder 121 changes the original data 11 to 01 to serve as the pixel data D', and therefore the DAC 123 selects the reference voltage VR(3) of the conductive line L(1) to serve as the drive voltage V according to the pixel data D" (i.e. 01).

TABLE 2

Rearrangement Table of Rearrangement Circuit 150

| Output Line | Reference Voltage |
|---|---|
| L(0) | VR(0) |
| L(1) | VR(3) |
| L(2) | VR(2) |
| L(3) | VR(1) |

Figure 10:
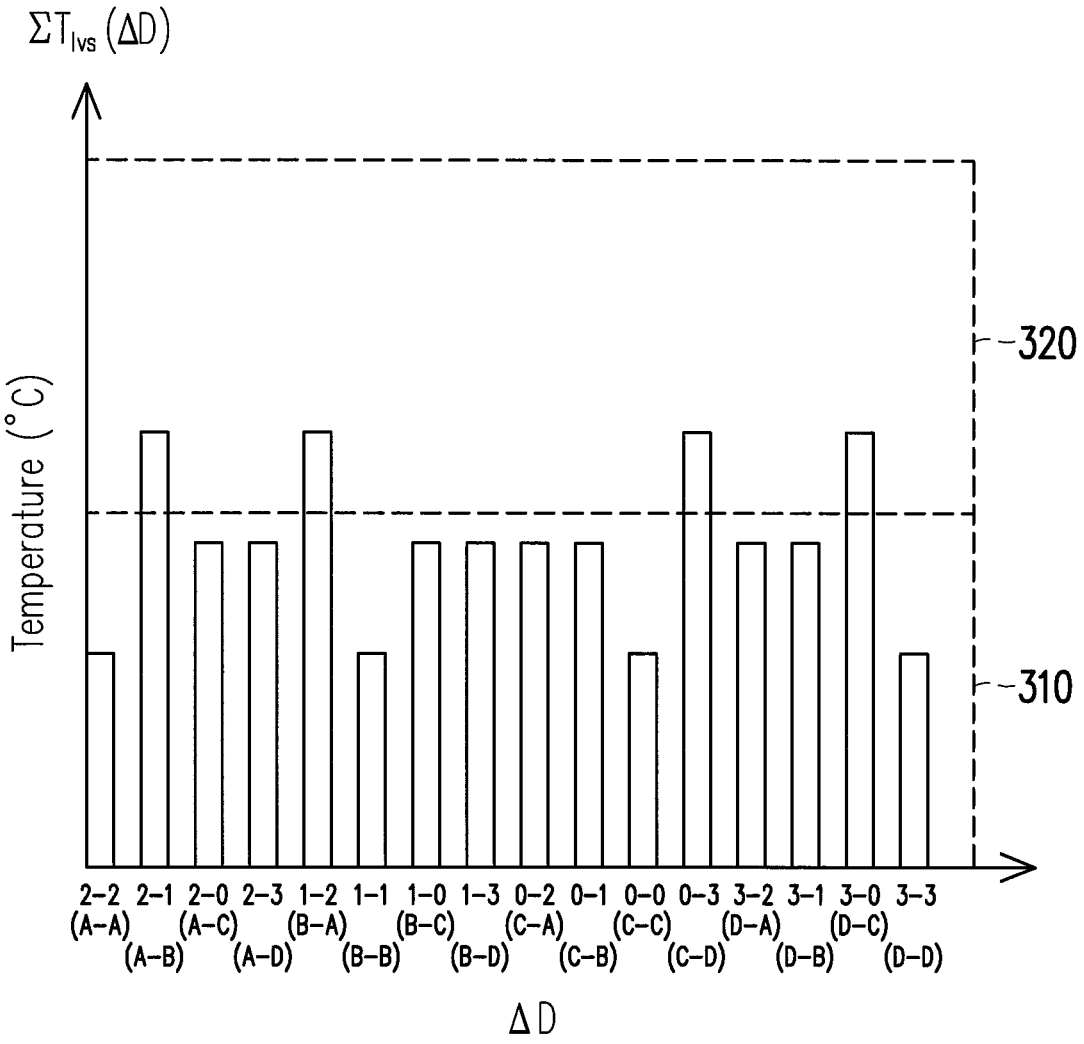
FIG. 10 is a diagram depicting the relationships between data transition patterns ΔD and temperatures $\Sigma_1^{CH}T_{lvs}(\Delta D)$ of the level shifter according to another embodiment of the invention, after the corresponding relationships between data transition patterns ΔD and voltage transition patterns $\Delta V_{OUT}$ have been adjusted.

FIG. 10 is a diagram depicting the relationships between data transition patterns ΔD and temperatures $\Sigma_1^{CH}T_{lvs}(\Delta D)$ of the level shifter according to another embodiment of the invention, after the corresponding relationships between data transition patterns ΔD and voltage transition patterns $\Delta V_{OUT}$ have been adjusted. FIG. 10 may be deduced by referring to the related description of FIGS. 3A, 6, 8 and 9. The embodiment depicted in FIG. 10 also assumes the pixel data of the panel driver IC 100 in FIG. 1 is a 2-bit data. Table 3 is a data mapping table of the data encoder 121 shown in FIG. 1 according to the embodiment depicted in FIG. 10. A difference from the embodiment depicted in FIG. 8 is that, no matter what the pixel data D is, the data encoder 121 in the embodiment depicted in FIG. 10 continually performs the encoding operation according to the data mapping table of Table 3.

TABLE 3

Data Mapping Table of Data Encoder 121

| Original Pixel Data D (decimal) | Original Pixel Data D (binary) | Output Pixel Data D' (binary) |
|---|---|---|
| 0 | 00 | 10 |
| 1 | 01 | 01 |
| 2 | 10 | 00 |
| 3 | 11 | 11 |

Table 4 is a rearrangement table of the rearrangement circuit 150 according to the embodiment depicted in FIG. 10. According to the encoding operation performed by the data encoder 121 using the data mapping table of Table 3, the rearrangement circuit 150 in the embodiment of FIG. 10 continually performs the rearrangement operation according to the rearrangement table of Table 4. For example, when the original pixel data D is 00, the data encoder 121 changes the original data 00 to 10 (i.e. 2) to serve as the pixel data D', and therefore the DAC 123 selects the reference voltage VR(0) of the conductive line L(2) to serve as the drive voltage V according to the pixel data D" (i.e. 10). When the original pixel data D is 01, the data encoder 121 directly outputs 01 to serve as the pixel data D', and therefore the DAC 123 selects the reference voltage VR(1) of the conductive line L(1) to serve as the drive voltage V according to the pixel data D" (i.e. 01). When the original pixel data D is 10 (i.e. 2), the data encoder 121 changes the original data 10 to 00 to serve as the pixel data D', and therefore the DAC 123 selects the reference voltage VR(2) of the conductive line L(0) to serve as the drive voltage V according to the pixel data D" (i.e. 00). When the original pixel data D is 11 (i.e. 3), the data encoder 121 directly outputs 11 to serve as the pixel data D', and therefore the DAC 123 selects the reference voltage VR(3) of the conductive line L(3) to serve as the drive voltage V according to the pixel data D" (i.e. 11).

TABLE 4

Rearrangement Table of Rearrangement Circuit 150

| Output Line | Reference Voltage |
|---|---|
| L(0) | VR(2) |
| L(1) | VR(1) |
| L(2) | VR(0) |
| L(3) | VR(3) |

It is assumed here that the pixel data of the panel driver IC 100 in FIG. 1 is a $\log_2 N$ bit data. Table 5 is a data mapping table of the data encoder 121 shown in FIG. 1 according to another embodiment of the invention. As shown in Table 5, the original pixel data D is divided into two groups, 0 to (n−1) and n to (N−1), in which n is an integer between 0 to N. In the 0 to (n−1) group, the output pixel data D' is maintained the same as the original pixel data D (not changed). In the n to (N−1) group, encoding is used to invert the data, as shown in Table 5.

TABLE 5

Data Mapping Table of Data Encoder 121

| Original Pixel Data D | Output Pixel Data D' |
|---|---|
| D(0) | D(0) |
| D(1) | D(1) |
| . . . | . . . |
| D(n − 2) | D(n − 2) |
| D(n − 1) | D(n − 1) |
| D(n) | D(N − 1) |
| D(n + 1) | D(N − 2) |
| . . . | . . . |
| D(N − 2) | D(n + 1) |
| D(N − 1) | D(n) |

Table 6 is a rearrangement table of the rearrangement circuit 150 according to the embodiment depicted in Table 5. According to the encoding operation performed by the data encoder 121 using the data mapping table of Table 5, the rearrangement circuit 150 continually performs the rearrangement operation according to the rearrangement table of Table 6.

TABLE 6

Rearrangement Table of Rearrangement Circuit 150

| Output Line | Reference Voltage |
|---|---|
| L(0) | VR(0) |
| L(1) | VR(1) |
| . . . | . . . |
| L(n − 2) | VR(n − 2) |
| L(n − 1) | VR(n − 1) |
| L(n) | VR(N − 1) |
| L(n + 1) | VR(N − 2) |
| . . . | . . . |
| L(N − 2) | VR(n + 1) |
| L(N − 1) | VR(n) |

For example, assuming the pixel data of the panel driver IC 100 shown in FIG. 1 is an 8-bit data, then the data mapping table of Table 5 can be arranged into the data mapping table of Table 7, and the rearrangement table of Table 6 can be arranged into the rearrangement table of Table 8. As shown by Table 7, the 8-bit pixel data D is divided into two groups, 0 to 127 and 128 to 255. The output of the 0 to 127 group maintains the original state, but the 128 to 255 group uses encoding to invert the data, as shown by Table 7.

TABLE 7

Data Mapping Table of Data Encoder 121

| Original Pixel Data D (decimal) | Original Pixel Data D (binary) | Output Pixel Data D' (binary) |
|---|---|---|
| 0 | 00000000 | 00000000 |
| 1 | 00000001 | 00000001 |
| 2 | 00000010 | 00000010 |
| 3 | 00000011 | 00000011 |
| . . . | . . . | . . . |
| . . . | . . . | . . . |
| 124 | 01111100 | 01111100 |
| 125 | 01111101 | 01111101 |
| 126 | 01111110 | 01111110 |
| 127 | 01111111 | 01111111 |
| 128 | 10000000 | 11111111 |
| 129 | 10000001 | 11111110 |
| 130 | 10000010 | 11111101 |
| 131 | 10000011 | 11111100 |
| . . . | . . . | . . . |
| . . . | . . . | . . . |
| 252 | 11111100 | 10000011 |
| 253 | 11111101 | 10000010 |
| 254 | 11111110 | 10000001 |
| 255 | 11111111 | 10000000 |

Table 8 is a rearrangement table of the rearrangement circuit 150 according to the embodiment depicted in Table 7. According to the encoding operation performed by the data encoder 121 using the data mapping table of Table 7, the rearrangement circuit 150 continually performs the rearrangement operation according to the rearrangement table of Table 8. For example, when the original pixel data D transitions from 00000000 to 11111111 (i.e. 255), the data encoder 121 changes the original data 11111111 to 10000000 (i.e. 128) to serve as the pixel data D'. Since a transition occurs for only one bit in the data transition pattern ΔD of the level shifter 122 (because the pixel data D" transitions from 00000000 to 10000000), the data transition pattern ΔD belongs to the low temperature region 310. The DAC 123 selects the reference voltage VR(255) of the conductive line L(128) to serve as the drive voltage V according to the pixel data D" (i.e. 10000000). Since the voltage transition pattern $\Delta V_{OUT}$ of the output buffer 124 transitions from the reference voltage VR(0) to VR(255), the voltage transition pattern $\Delta V_{OUT}$ belongs to the high temperature region 340. In other words, by changing the corresponding relationships between the data transition patterns ΔD of the level shifter 122 and the voltage transition patterns $\Delta V_{OUT}$ of the output buffer 124, the embodiments depicted in Tables 7 and 8 can reduce the temperature of the panel driver IC 100.

TABLE 8

Rearrangement Table of Rearrangement Circuit 150

| Output Line | Reference Voltage |
|---|---|
| L(0) | VR(0) |
| L(1) | VR(1) |
| . . . | . . . |
| L(126) | VR(126) |
| L(127) | VR(127) |
| L(128) | VR(255) |

TABLE 8-continued

Rearrangement Table of Rearrangement Circuit 150

| Output Line | Reference Voltage |
|---|---|
| L(129) | VR(254) |
| . . . | . . . |
| L(254) | VR(129) |
| L(255) | VR(128) |

Table 9 is a data mapping table of the data encoder 121 shown in FIG. 1 according to another embodiment of the invention. It is assumed here that the pixel data of the panel driver IC 100 in FIG. 1 is a $\log_2 N$ bit data. As shown in Table 9, the original pixel data D is divided into two groups, 0 to (n−1) and n to (N−1), in which n is an integer between 0 to N. In the 0 to (n−1) group, encoding is used to invert the pixel data, as shown in Table 9. In the n to (N−1) group, the output pixel data D' is maintained the same as the original pixel data D (not changed).

TABLE 9

Data Mapping Table of Data Encoder 121

| Original Pixel Data D | Output Pixel Data D' |
|---|---|
| D(0) | D(n − 1) |
| D(1) | D(n − 2) |
| . . . | . . . |
| D(n − 2) | D(1) |
| D(n − 1) | D(0) |
| D(n) | D(n) |
| D(n + 1) | D(n + 1) |
| . . . | . . . |
| D(N − 2) | D(N − 2) |
| D(N − 1) | D(N − 1) |

Table 10 is a rearrangement table of the rearrangement circuit 150 according to the embodiment depicted in Table 9. According to the encoding operation performed by the data encoder 121 using the data mapping table of Table 9, the rearrangement circuit 150 continually performs the rearrangement operation according to the rearrangement table of Table 10.

TABLE 10

Rearrangement Table of Rearrangement Circuit 150

| Output Line | Reference Voltage |
|---|---|
| L(0) | VR(n − 1) |
| L(1) | VR(n − 2) |
| . . . | . . . |
| L(n − 2) | VR(1) |
| L(n − 1) | VR(0) |
| L(n) | VR(n) |
| L(n + 1) | VR(n + 1) |
| . . . | . . . |
| L(N − 2) | VR(N − 2) |
| L(N − 1) | VR(N − 1) |

For example, assuming the pixel data of the panel driver IC 100 shown in FIG. 1 is an 8-bit data, then the data mapping table of Table 9 can be arranged into the data mapping table of Table 11, and the rearrangement table of Table 10 can be arranged into the rearrangement table of Table 12. As shown in Table 11, the 8-bit pixel data D is divided into two groups, 0 to 127 and 128 to 255. In the 0 to 127 group, encoding is used to invert the pixel data, as shown in Table 11. In the 128 to 255 group, the output pixel data D' is maintained the same as the original pixel data D (not changed).

TABLE 11

Data Mapping Table of Data Encoder 121

| Original Pixel Data D (decimal) | Original Pixel Data D (binary) | Output Pixel Data D' (binary) |
|---|---|---|
| 0 | 00000000 | 01111111 |
| 1 | 00000001 | 01111110 |
| 2 | 00000010 | 01111101 |
| 3 | 00000011 | 01111100 |
| . . . | . . . | . . . |
| . . . | . . . | . . . |
| 124 | 01111100 | 00000011 |
| 125 | 01111101 | 00000010 |
| 126 | 01111110 | 00000001 |
| 127 | 01111111 | 00000000 |
| 128 | 10000000 | 10000000 |
| 129 | 10000001 | 10000001 |
| 130 | 10000010 | 10000010 |
| 131 | 10000011 | 10000011 |
| . . . | . . . | . . . |
| . . . | . . . | . . . |
| 252 | 11111100 | 11111100 |
| 253 | 11111101 | 11111101 |
| 254 | 11111110 | 11111110 |
| 255 | 11111111 | 11111111 |

Table 12 is a rearrangement table of the rearrangement circuit 150 according to the embodiment depicted in Table 11. According to the encoding operation performed by the data encoder 121 using the data mapping table of Table 11, the rearrangement circuit 150 continually performs the rearrangement operation according to the rearrangement table of Table 12. For example, when the original pixel data D transitions from 11111111 (i.e. 255) to 00000000, the data encoder 121 changes the original data 00000000 to 01111111 (i.e. 127) to serve as the pixel data D'. Since a transition occurs for only one bit in the data transition pattern ΔD of the level shifter 122 (because the pixel data D" transitions from 11111111 to 01111111), the data transition pattern ΔD belongs to the low temperature region 310. The DAC 123 selects the reference voltage VR(0) of the conductive line L(127) to serve as the drive voltage V according to the pixel data D" (i.e. 01111111). Since the voltage transition pattern $\Delta V_{OUT}$ of the output buffer 124 transitions from the reference voltage VR(255) to VR(0), the voltage transition pattern $\Delta V_{OUT}$ belongs to the high temperature region 340. In other words, by changing the corresponding relationships between the data transition patterns ΔD of the level shifter 122 and the voltage transition patterns $\Delta V_{OUT}$ of the output buffer 124, the embodiments depicted in Tables 11 and 12 can reduce the temperature of the panel driver IC 100.

TABLE 12

Rearrangement Table of Rearrangement Circuit 150

| Output Line | Reference Voltage |
|---|---|
| L(0) | VR(127) |
| L(1) | VR(126) |
| . . . | . . . |
| L(126) | VR(1) |
| L(127) | VR(0) |
| L(128) | VR(128) |
| L(129) | VR(129) |
| . . . | . . . |

TABLE 12-continued

Rearrangement Table of Rearrangement Circuit 150

| Output Line | Reference Voltage |
|---|---|
| L(254) | VR(254) |
| L(255) | VR(255) |

In view of the foregoing, embodiments described above alter the corresponding relationships between the data transition patterns ΔD and the voltage transition patterns $\Delta V_{OUT}$, such that no relationship exists between data transition patterns ΔD belonging to the high temperature region 320 and voltage transition patterns $\Delta V_{OUT}$ belonging to the high temperature region 320. Therefore, the temperature of the panel driver IC 100 can be effectively reduced.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A panel driver integrated circuit (IC), comprising:

a data encoder receiving an original data and selectively performing an encoding operation, wherein the encoding operation changes the original data to serve as an output data of the data encoder according to a data mapping table;

a level shifter having an input terminal coupled to the data encoder to receive the output data;

a digital-to-analog converter (DAC) having a data input terminal coupled to an output terminal of the level shifter;

a rearrangement circuit having a plurality of output terminals coupled to a plurality of reference voltage input terminals of the DAC to provide a plurality of reference voltages, wherein the rearrangement circuit rearranges an order of the reference voltages according to the encoding operation of the data encoder; and an output buffer having an input terminal coupled to an output terminal of the DAC.

2. The panel driver IC according to claim 1, wherein in the data mapping table, when the original data is D(0), D(1), . . . , D(n−2), D(n−1), D(n), D(n+1), . . . , D(N−2), D(N−1) in sequence, the output data is D(0), D(1), . . . , D(n−2), D(n−1), D(N−1), D(N−2), . . . , D(n+1), D(n) in sequence, wherein N is a positive integer, and n is an integer between 0 to N.

3. The panel driver IC according to claim 2, wherein when the order of the reference voltages received by the input terminal of the rearrangement circuit is VR(0), VR(1), . . . , VR(n−2), VR(n−1), VR(n), VR(n+1), . . . , VR(N−2), VR(N−1), the order of the reference voltages outputted by the output terminal of the rearrangement circuit is VR(0), VR(1), . . . , VR(n−2), VR(n−1), VR(N−1), VR(N−2), . . . , VR(n+1), VR(n).

4. The panel driver IC according to claim 1, wherein in the data mapping table, when the original data is D(0), D(1), . . . , D(n−2), D(n−1), D(n), D(n+1), . . . , D(N−2), D(N−1) in sequence, the output data is D(n−1), D(n−2), . . . , D(1), D(0), D(n), D(n+1), . . . , D(N−2), D(N−1) in sequence, wherein N is a positive integer, and n is an integer between 0 to N.

5. The panel driver IC according to claim 4, wherein when the order of the reference voltages received by the input terminal of the rearrangement circuit is VR(0), VR(1), . . . , VR(n−2), VR(n−1), VR(n), VR(n+1), . . . , VR(N−2), VR(N−1), the order of the reference voltages outputted by the output terminal of the rearrangement circuit is VR(n−1), VR(n−2), . . . , VR(1), VR(0), VR(n), VR(n+1), . . . , VR(N−2), VR(N−1).

6. The panel driver IC according to claim 1, wherein different data transition patterns of the level shifter comprise a first transition pattern and a second transition pattern, the first transition pattern belongs to a high temperature region in different temperatures of the level shifter, the second transition pattern belongs to a low temperature region in the different temperatures of the level shifter, different voltage transition patterns a of the output buffer comprise a third transition pattern and a fourth transition pattern, the third transition pattern belongs to a high temperature region in different temperatures of the output buffer, and the fourth transition pattern belongs to a low temperature region in the different temperatures of the output buffer, wherein when the first transition pattern and the third transition pattern have a corresponding relationship, the data encoder and the rearrangement circuit replace the first transition pattern with the second transition pattern to enable the second transition pattern to establish a corresponding relationship with the third transition pattern, or replace the third transition pattern with the fourth transition pattern to enable the fourth transition pattern to establish a corresponding relationship with the first transition pattern.

7. The panel driver IC according to claim 6, wherein the data encoder changes an input data of the level shifter according to the data mapping table, and the rearrangement circuit rearranges an order of the reference voltages of the DAC according to the data mapping table.

* * * * *